US010604945B2

(12) United States Patent
Volponi et al.

(10) Patent No.: US 10,604,945 B2
(45) Date of Patent: Mar. 31, 2020

(54) LIPPAGE CONTROL SYSTEM WITH STRETCHABLE STRAP PORTION

(71) Applicant: New Standards Manufacturing Co., Keokuk, IA (US)

(72) Inventors: Michele Volponi, Keokuk, IA (US); James P Hoffman, Keokuk, IA (US); Ernest L Perry, IV, Vinton, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 0 days.

(21) Appl. No.: 15/711,159

(22) Filed: Sep. 21, 2017

(65) Prior Publication Data

US 2018/0100315 A1 Apr. 12, 2018

Related U.S. Application Data

(60) Provisional application No. 62/397,724, filed on Sep. 21, 2016.

(51) Int. Cl.

| | |
|---|---|
| ***E04F 15/02*** | (2006.01) |
| ***E04F 21/18*** | (2006.01) |
| ***E04F 21/00*** | (2006.01) |
| ***E04F 13/08*** | (2006.01) |

(52) U.S. Cl.

CPC .... *E04F 15/02022* (2013.01); *E04F 21/0092* (2013.01); *E04F 21/1844* (2013.01); *E04F 13/0892* (2013.01)

(58) Field of Classification Search

CPC ..... E04F 15/02022; E04F 21/0092; E04F 21/1844; E04F 21/22; E04F 21/1877; E04F 21/20; E04F 13/0892; E04F 15/02005; E04F 21/185

See application file for complete search history.

(56) References Cited

U.S. PATENT DOCUMENTS

| | | | | |
|---|---|---|---|---|
| 1,918,228 | A | 7/1933 | Spencer | |
| 2,277,892 | A | 3/1942 | Swenson | |
| 3,511,001 | A | 5/1970 | Morgan | |
| 4,397,125 | A | 8/1983 | Gusler | |
| 4,503,654 | A | 3/1985 | Cosentino | |
| 4,744,194 | A | 5/1988 | Yasuyoshi | |
| 4,862,668 | A | 9/1989 | DeGooyer | |
| 5,345,990 | A | 9/1994 | Potts | |
| 5,350,399 | A | 9/1994 | Erlebacher et al. | |
| 5,363,560 | A * | 11/1994 | Makow | E04F 15/02016 33/527 |

(Continued)

FOREIGN PATENT DOCUMENTS

| | | | |
|---|---|---|---|
| JP | 07-305494 | A | 11/1995 |
| KR | PCT/US2012/055482 | | 5/2013 |

OTHER PUBLICATIONS

Kufner et al, The Lippage-Free Tile System, Web (www.tuscanleveling.com), 2006, Fairfield, IA.

*Primary Examiner* — Basil S Katcheves
*Assistant Examiner* — Omar F Hijaz
(74) *Attorney, Agent, or Firm* — Simmons Perrine Moyer Bergman PLC

(57) ABSTRACT

A tile aligning and lippage tuning system that uses a single piece base and strap which is designed to break away from the base when sufficient pressure is applied and is also designed to stretch along a thin wall region before separation of the strap from the base occurs.

14 Claims, 4 Drawing Sheets

(56) References Cited

U.S. PATENT DOCUMENTS

| | | | | |
|---|---|---|---|---|
| 5,603,195 | A | 2/1997 | Cosentino | |
| 5,675,942 | A | 10/1997 | Crawford | |
| 5,843,546 | A | 12/1998 | Eichhorn | |
| 6,022,351 | A | 2/2000 | Bremer et al. | |
| 6,253,515 | B1 | 7/2001 | Kuelker | |
| 6,625,951 | B1 | 9/2003 | McCarthy | |
| 6,755,834 | B2 | 6/2004 | Amis | |
| 7,257,926 | B1 | 8/2007 | Kirby | |
| D552,266 | S | 10/2007 | Murdock | |
| 7,621,100 | B2 | 11/2009 | Kufner et al. | |
| D621,966 | S | 8/2010 | Vaes | |
| D630,077 | S | 1/2011 | Kufner et al. | |
| D630,078 | S | 1/2011 | Kufner et al. | |
| 7,861,487 | B2 | 1/2011 | Kufner et al. | |
| 7,946,093 | B1 | 5/2011 | Sturino | |
| D640,119 | S | 6/2011 | Kufner et al. | |
| 7,954,300 | B1 | 6/2011 | Kufner et al. | |
| 7,992,354 | B2 | 8/2011 | Doda | |
| 8,079,199 | B1 | 12/2011 | Kufner et al. | |
| D658,963 | S | 5/2012 | Kufner et al. | |
| 8,181,420 | B2 | 5/2012 | Comas | |
| 8,241,342 | B2 | 8/2012 | Kirschman | |
| 8,429,787 | B2 | 4/2013 | Maynard et al. | |
| 8,429,878 | B1 | 4/2013 | Hoffman et al. | |
| 8,429,879 | B1 | 4/2013 | Hoffman et al. | |
| 8,800,246 | B2 | 8/2014 | Gorton | |
| 9,010,064 | B1 | 4/2015 | Farahmandpour | |
| 9,027,308 | B2 | 5/2015 | Kufner et al. | |
| 9,045,911 | B2 | 6/2015 | Hoffman et al. | |
| 9,097,026 | B2 | 8/2015 | Hoffman et al. | |
| 9,149,276 | B2 | 10/2015 | Voss | |
| 9,228,363 | B2 | 1/2016 | Kufner et al. | |
| 9,267,297 | B2 | 2/2016 | Zinssler | |
| 9,279,259 | B1 | 3/2016 | Russo | |
| 9,322,185 | B1 | 4/2016 | Russo | |
| 9,353,515 | B2 | 5/2016 | Farahmandpour | |
| 9,433,438 | B2 | 9/2016 | Memmolo et al. | |
| 9,464,448 | B2 | 10/2016 | Hoffman et al. | |
| 9,657,485 | B2 | 5/2017 | Meyers | |
| 9,874,032 | B1 * | 1/2018 | Chen | H05K 999/99 |
| 2003/0229349 | A1 | 12/2003 | Wellisz et al. | |
| 2006/0185269 | A1 | 8/2006 | Kufner et al. | |
| 2006/0185319 | A1 | 8/2006 | Kufner et al. | |
| 2007/0214743 | A1 | 9/2007 | Alvarez | |
| 2008/0141617 | A1 | 6/2008 | Joski | |
| 2008/0236094 | A1 | 10/2008 | Doda | |
| 2008/0275511 | A1 | 11/2008 | Weinacker et al. | |
| 2010/0263304 | A1 | 10/2010 | Comas | |
| 2010/0287868 | A1 * | 11/2010 | Kufner | E04F 21/0092 52/391 |
| 2011/0011031 | A1 | 1/2011 | Kufner et al. | |
| 2011/0265424 | A1 | 11/2011 | Kufner et al. | |
| 2012/0085066 | A1 | 4/2012 | Kufner et al. | |
| 2012/0144773 | A1 | 6/2012 | Bondielli | |
| 2012/0198789 | A1 * | 8/2012 | Noutsis | E04F 21/0092 52/747.11 |
| 2013/0055675 | A1 | 3/2013 | Sighinolfi | |
| 2013/0067854 | A1 | 3/2013 | Bordin | |
| 2013/0074425 | A1 | 3/2013 | Miyamoto | |
| 2013/0247508 | A1 | 9/2013 | Hoffman et al. | |
| 2013/0255182 | A1 | 10/2013 | Kufner et al. | |
| 2014/0116001 | A1 | 5/2014 | Ghelfi | |
| 2014/0223755 | A1 | 8/2014 | Madrack | |
| 2014/0283401 | A1 | 9/2014 | Kufner et al. | |
| 2014/0298736 | A1 | 10/2014 | Bunch et al. | |
| 2014/0325935 | A1 | 11/2014 | Hoffman et al. | |
| 2014/0325936 | A1 | 11/2014 | PSaila et al. | |
| 2015/0027082 | A1 | 1/2015 | Hoffman et al. | |
| 2015/0113895 | A1 | 4/2015 | Zinssler | |
| 2015/0211243 | A1 | 7/2015 | Irvine et al. | |
| 2015/0308130 | A1 | 10/2015 | Biec | |
| 2016/0053501 | A1 | 2/2016 | Comas | |
| 2016/0348381 | A1 | 12/2016 | Meyers | |
| 2017/0044779 | A1 * | 2/2017 | Teng | E04F 21/1877 |
| 2018/0023307 | A1 * | 1/2018 | Quesada Barbero | E04F 21/20 52/126.5 |

* cited by examiner

LIPPAGE CONTROL SYSTEM WITH STRETCHABLE STRAP PORTION

CROSS REFERENCE TO RELATED APPLICATIONS

The present application claims the benefit of the filing date of provisional patent application having Ser. No. 62/397,724 filed on Sep. 21, 2016 by the same inventors, which application is incorporated herein in its entirety by this reference.

BACKGROUND OF THE INVENTION

This invention relates to systems and methods for laying tile and, more specifically, for efficiently reducing tile lippage. Throughout this description, the term tile is used as an example of various matter which is arranged or disposed adjacent a substrate (which can be horizontal—floors or vertical—walls or other) in multiple pieces, the term tile should be understood to include panels, sheets, boards, paving stones, bricks, stone or porcelain slabs or the like. The present invention relates more specifically to improved methods and systems which use tab systems to align tiles.

U.S. Pat. Nos. 7,861,487; 8,429,878 and. 8,429,879 and U.S. Design Pat. D630077 and the web site www.tuscanleveling.com describe a system for aligning tiles. While such systems have enjoyed some success in the past, they do have drawbacks. Typically, such systems require the use of a tool to tighten a strap and cap combination. The tile laying professional would typically use the tool by firmly grasping a lever, trigger or other structure on the tool and causing the gap between the cap and the base of the strap to decrease. The amount and duration of the squeezing of the tool, in some designs, may determine the amount of relative movement between the cap and the base of the strap. Knowing how hard to squeeze and when to stop could be a critical skill in certain applications. Also having the requisite hand grasping strength could be an issue for some tile laying professionals.

Consequently, there is a need for improvement in tile aligning and lippage tuning systems and methods.

SUMMARY OF THE INVENTION

More specifically, an object of the invention is to provide a cost effective tile aligning and mechanical edge setting system.

It is a feature of the present invention to be a one piece base and strap structure.

It is an advantage of the present invention to decrease the time required to perform each job.

It is another feature of the invention to include a stretchable strap, tab or shaft, while the tab remains in place attached to the base located under the tile.

It is also an advantage of the present invention to provide improved ease of use and reduce unwanted strap breakage.

The present invention includes the above-described features and achieves the aforementioned objects.

Accordingly, the present invention comprises a tile leveling and mechanical edge setting system with a one piece base and strap combination with a detachable stretchable strap.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
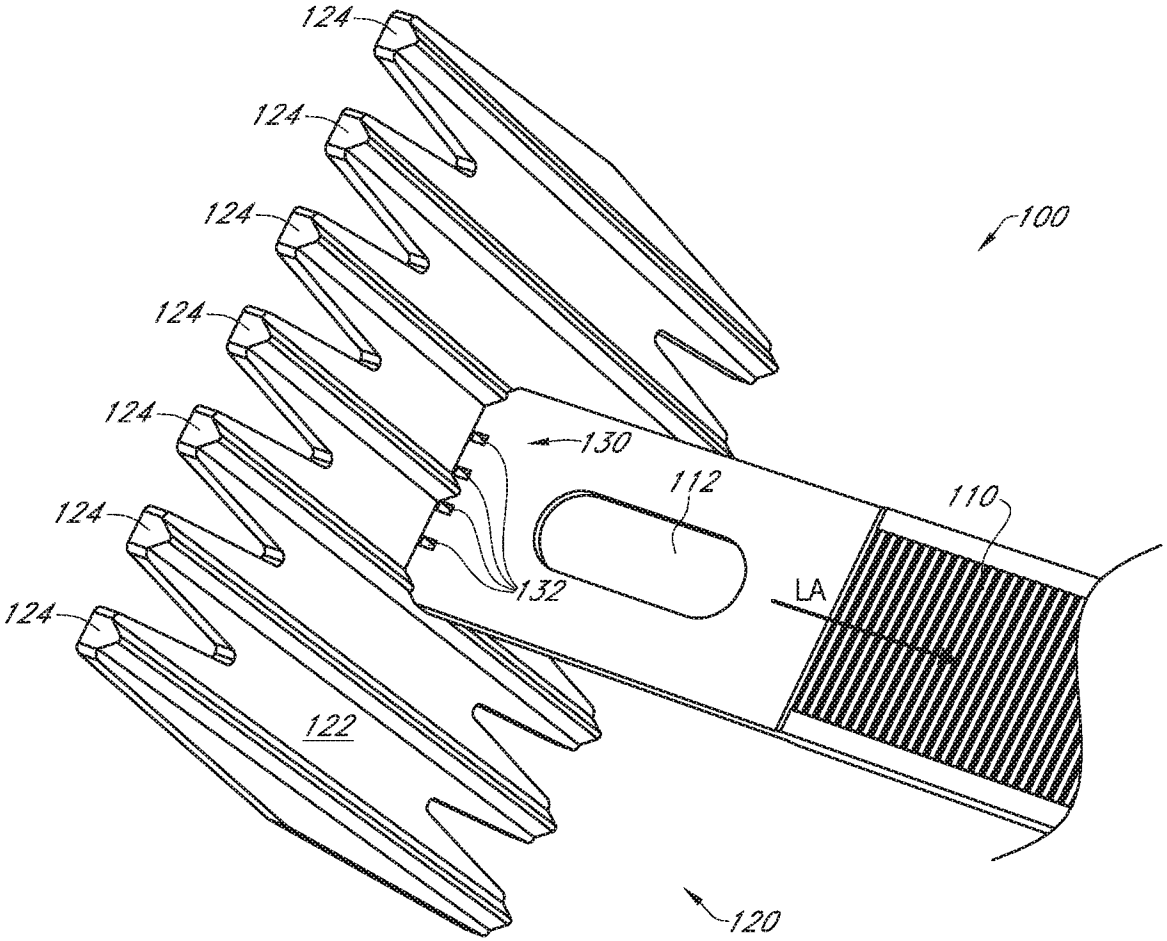
FIG. 1 is a perspective view of a strap and base/plate combination of the present invention.
Figure 2:
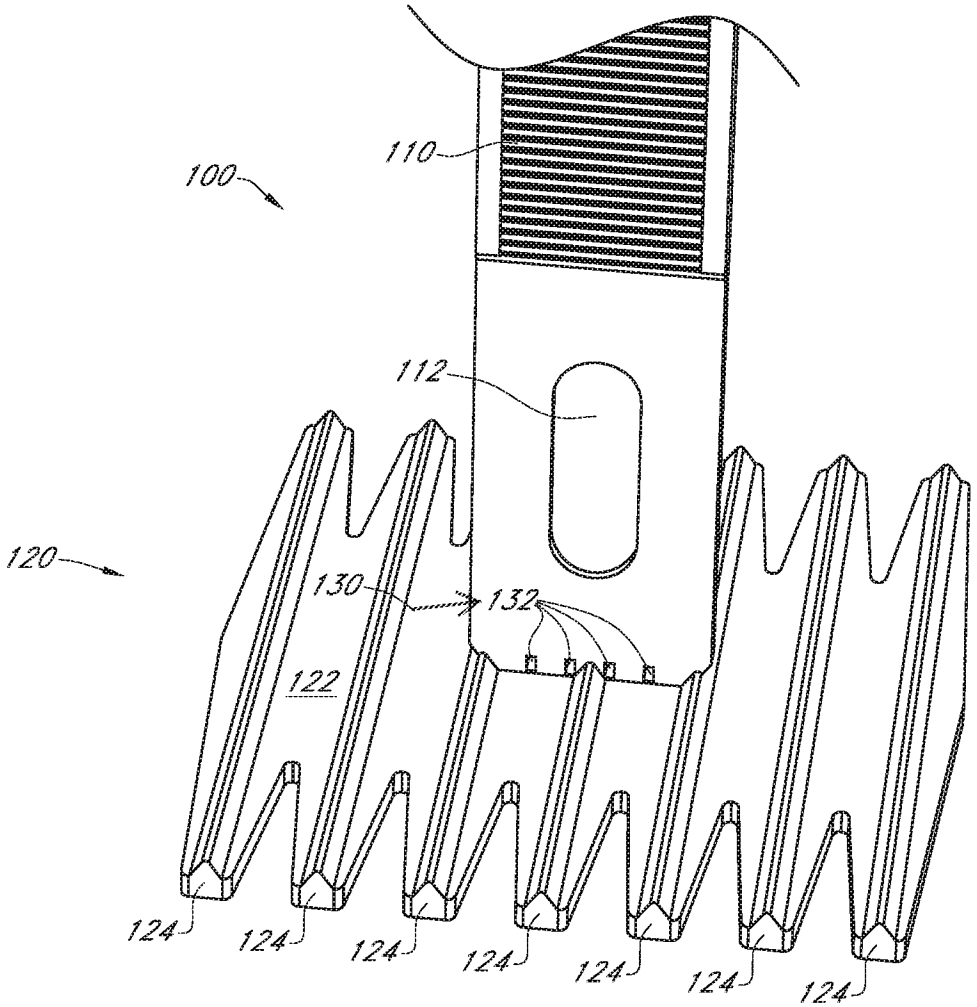
FIG. 2 shows an alternate perspective view of the strap of FIG. 1.
Figure 3:
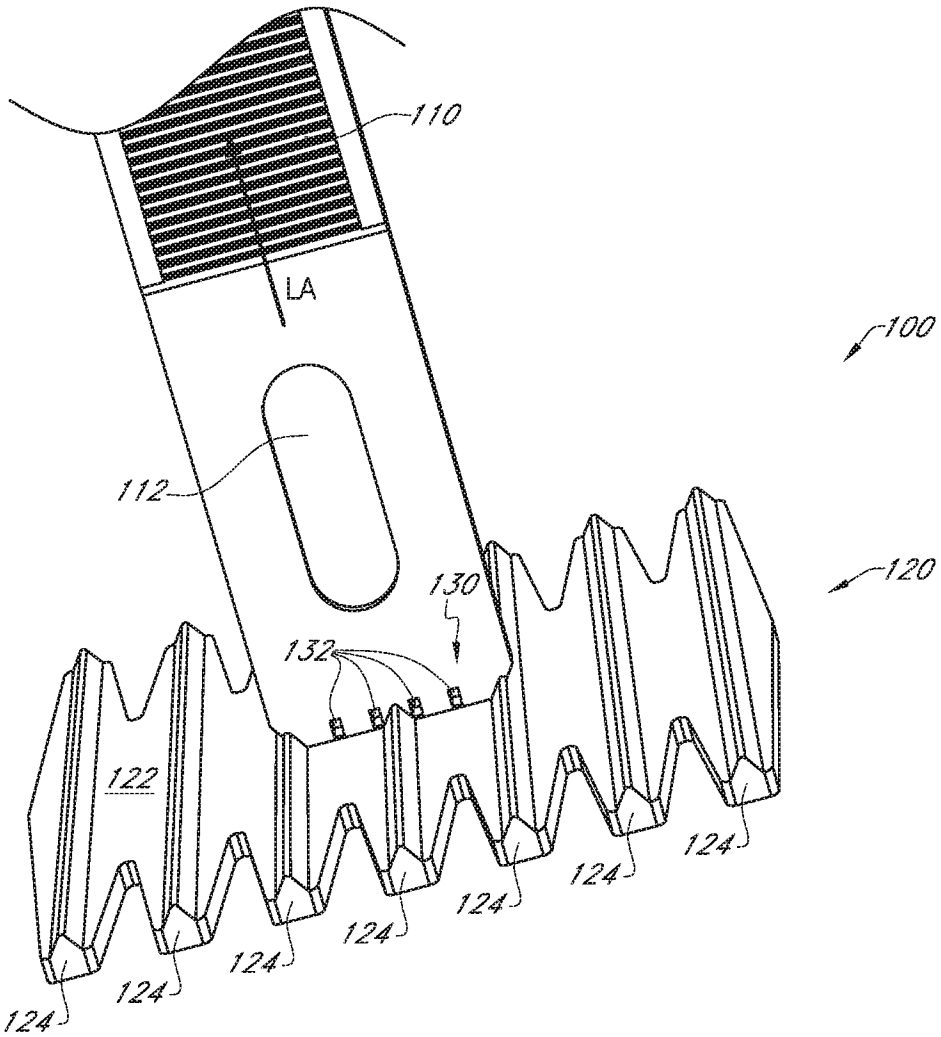
FIG. 3 shows an alternate view of the strap of FIGS. 1 and 2.

Now referring to FIGS. 1-3 where like numerals refer to like matter throughout. There is shown a one-piece plate strap combination 100 of the present invention which shows a strap 110, with a thin wall region 112 therein to allow for easier stretching of the strap 110 along its longitudinal axis LA. The strap 110 is formed with the bottom plate 120 which is formed a planar base 122 with a plurality of triangular cross section ridges 124 formed thereon where the apex of the triangular cross section is further along the longitudinal axis LA than the base plate portion 122. A plurality of voids 132 are located at the bottom thicker wall portion 130 of the strap 110, which voids are designed to allow easier separation of the strap 110 from the base plate 122. Voids 132 are ideally located adjacent to the base plate 122 and do not extent as far along the LA as do the tops of the ridges 124. The materials chosen for the combination 100 can be any suitable material where there is no significant compression or deflection of the ridges 124 when the system is deployed in normal and even abnormal conditions with excessive pressure being applied thereon. The material chosen would allow the strap to stretch on the LA and would allow the strap 110 to be separated from the base 122 through the voids 132 so that the separation point of the strap 110 and the bottom 120 is at a point along the LA closer to base plate 122 than the apex of the ridges 124 when they are fully loaded with pressure greater than the maximum needed for all reasonable uses of the combination 100.

Figure 4:
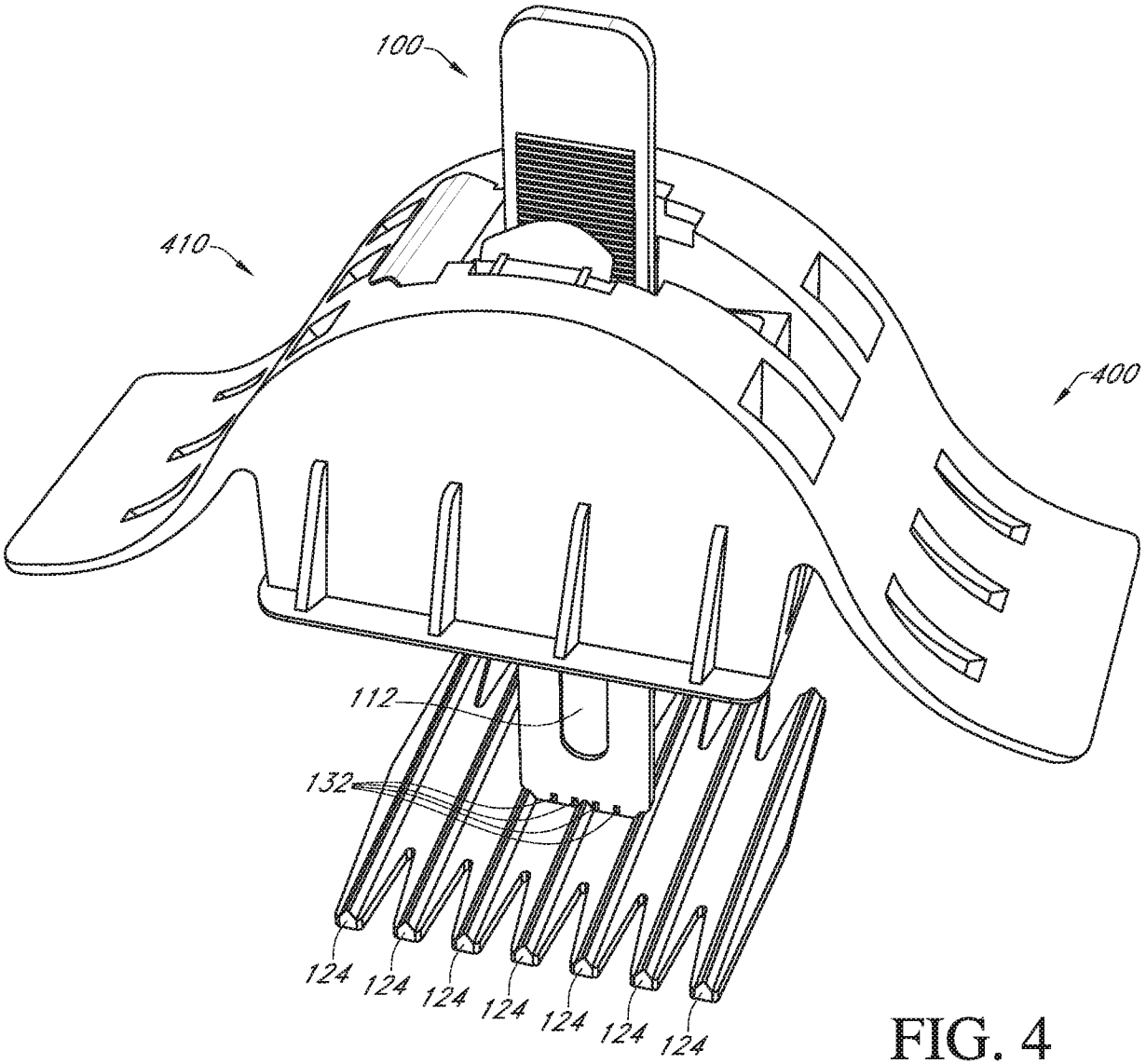
FIG. 4 shows a combination of the straps of FIGS. 1-3 and a flexible cap.

Now referring to FIG. 4, there is shown a system generally designated 400 which includes a cap 410 and the plate strap combination 100. Cap 410 is similar to the prior art cap shown in U.S. Pat. No. 8,429,878.

Throughout this description, the term lippage is used and is hereby defined as meaning relatively uneven edges existing with respect to adjacent tiles arranged in an array.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

We claim:

1. A tile aligning and leveling system comprising:

a cap, configured to remain on a first side of a tile;

a connecting tab with a bottom portion and a longitudinal axis, wherein said connecting tab is configured to mate with said cap;

a base configured to be placed on an opposite side of said first side, said base having a plate and a plurality of triangular cross section ridges thereon;

said connecting tab having a thin wall region which is immediately adjacent to and completely surrounded by a second region which has a larger thickness characteristic than said thin wall region, which is further configured to permit stretching of the connecting tab across the thin wall region and in a direction parallel to said longitudinal axis;

said bottom portion having a thickness greater than said thin wall region and having a plurality of voids disposed therein to permit detachment of said connecting tab from said plate; and wherein said voids are located in an area of said bottom portion between an apex of one of said plurality of triangular cross section ridges and said plate.

2. The system of claim 1 wherein said connecting tab has a top end and wherein said thin wall region is proximal to said plate.

3. The system of claim 1 wherein said thin wall region is oval in shape.

4. The system of claim 2 wherein said thin wall region is oval in shape.

5. The system of claim 4 wherein said thin wall region has a stretchable longitudinal axis which is parallel to said longitudinal axis.

6. The system of claim 1 wherein said thin wall region has a stretchable longitudinal axis which is parallel to said longitudinal axis.

7. The system of claim 6 wherein said thin wall region is oval in shape, completely surrounded by a non-thin wall region and proximal to said plate.

8. A tile aligning and leveling system comprising:

a cap, configured to remain on a first side of a tile;

a connecting tab with a bottom portion and a longitudinal axis, wherein said connecting tab is configured to mate with said cap;

a base configured to be placed on an opposite side of said first side, said base having a plate and a plurality of ridges thereon;

said connecting tab having a thin wall region to permit stretching of the connecting tab across the thin wall region and in a direction parallel to said longitudinal axis, where said thin wall region which is immediately adjacent to and completely surrounded by a second region which has a larger thickness characteristic than said thin wall region;

said bottom portion having a thickness greater than said thin wall region and having a plurality of voids disposed therein to permit detachment of said connecting tab from said plate; and wherein said voids are located in an area of said bottom portion between an apex of one of said plurality of ridges and said plate.

9. The system of claim 8 wherein said connecting tab has a top end and wherein said thin wall region is proximal to said plate.

10. The system of claim 9 wherein said thin wall region is oval in shape and is completely surrounded by a non-thin wall region.

11. The system of claim 8 wherein said thin wall region is oval in shape and is completely surrounded by a non-thin wall region.

12. The system of claim 10 wherein said thin wall region has a stretchable longitudinal axis which is parallel to said longitudinal axis.

13. The system of claim 8 wherein said thin wall region has a stretchable longitudinal axis which is parallel to said longitudinal axis.

14. The system of claim 13 wherein said thin wall region is oval in shape, completely surrounded by a non-thin wall region and proximal to said plate.

* * * * *